US008308160B2

(12) United States Patent
Miyazawa

(10) Patent No.: US 8,308,160 B2
(45) Date of Patent: Nov. 13, 2012

(54) SHEET CONVEYING APPARATUS AND IMAGE FORMING APPARATUS WITH OBLIQUE FEED ROLLERS

(75) Inventor: Hideaki Miyazawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/797,126

(22) Filed: Jun. 9, 2010

(65) Prior Publication Data

US 2010/0327519 A1 Dec. 30, 2010

(30) Foreign Application Priority Data

Jun. 29, 2009 (JP) ..... 2009-153215

(51) Int. Cl.
*B65H 9/16* (2006.01)

(52) U.S. Cl. ..... 271/251; 271/229; 271/273

(58) Field of Classification Search ..... 271/251, 271/229, 273

See application file for complete search history.

(56) References Cited

U.S. PATENT DOCUMENTS

| | | | | |
|---|---|---|---|---|
| 2,995,364 | A * | 8/1961 | Frederick et al. | 271/251 |
| 3,148,877 | A * | 9/1964 | Brearley | 271/251 |
| 4,809,968 | A * | 3/1989 | Malachowski | 271/251 |
| 5,253,862 | A | 10/1993 | Acquaviva et al. | |
| 6,273,418 | B1 | 8/2001 | Fujikura et al. | |
| 6,789,794 | B2 | 9/2004 | Miyazawa | |
| 7,306,221 | B2 * | 12/2007 | Agata | 271/251 |
| 7,392,982 | B2 * | 7/2008 | Farmer et al. | 271/245 |
| 7,900,914 | B2 * | 3/2011 | Fujita et al. | 271/251 |
| 2009/0091075 | A1 * | 4/2009 | Yasumoto | 271/250 |
| 2009/0160125 | A1 * | 6/2009 | Fujita et al. | 271/227 |
| 2010/0025918 | A1 | 2/2010 | Miyazawa | |

* cited by examiner

*Primary Examiner* — Gerald McClain
(74) *Attorney, Agent, or Firm* — Fitzpatrick, Cella, Harper & Scinto

(57) ABSTRACT

A sheet conveying apparatus and an image forming apparatus are provided. The sheet conveying speed of a pair of conveying rollers which convey a sheet to a skew feeding correction device 55 and can be contacted and separated is set to be a speed in which the sheet obliquely conveyed by a pair of first oblique feed rollers is warped between the pair of first oblique feed rollers and the pair of conveying rollers. After the sheet is warped, a separation mechanism is controlled to separate the pair of conveying rollers.

4 Claims, 15 Drawing Sheets

DETAILED DIAGRAM A OF SIDE END OF SHEET S

SHEET CONVEYING APPARATUS AND IMAGE FORMING APPARATUS WITH OBLIQUE FEED ROLLERS

BACKGROUND OF THE INVENTION

1. Field of the Invention

The present invention relates to a sheet conveying apparatus and an image forming apparatus. More specifically, the present invention relates to a configuration which corrects skew feeding and the position in the width direction of a sheet.

2. Description of the Related Art

In the related art, an image forming apparatus, such as a copying machine, a printer, and a facsimile machine, has a sheet conveying apparatus which conveys a sheet to an image forming portion. When skew feeding and displacement of the position in the width direction orthogonal to the sheet conveying direction (lateral registration position) occur in the sheet conveyed toward the image forming portion, an image whose image position is displaced is formed on the sheet. Accordingly, the sheet conveying apparatus of the related art has a skew feeding correction portion which corrects skew feeding of the sheet and aligns the lateral registration position on the upstream in the sheet conveying direction of the image forming portion. One example of such skew feeding correction portion corrects displacement of the side end of the sheet conveyed according to side registration reference (see U.S. Pat. No. 6,273,418).

SUMMARY OF THE INVENTION

The skew feeding correction portion which aligns the sheet according to the side registration reference has an abutment reference member on one side of a sheet conveying path along the sheet conveying direction and arranges a plurality of oblique feed rollers on the sheet conveying path. The oblique feed rollers obliquely convey the sheet conveyed by a sheet conveying roller provided on the upstream in the sheet conveying direction toward the abutment reference member to move the sheet to the side of the abutment reference member, and abut the side end of the sheet onto the abutment reference member to correct both displacement in the width direction and inclination of the side end of the sheet. In the skew feeding correction portion having such configuration, when the pressing force of the sheet onto the abutment reference member (the force of the oblique feed rollers which move the sheet to the side of the abutment reference member) upon the abutment of the side end of the sheet onto the abutment reference member is too strong, a sheet jam and lowering of the correction accuracy can be caused. Accordingly, the sheet conveying apparatus which changes the nip pressure of the oblique feed rollers according to the type of sheet to adjust the pressing force of the side end of sheet onto the abutment reference member and moves the side end of the sheet along the abutment reference member, thereby correcting skew feeding, has been proposed (see U.S. Pat. No. 5,253,862).

In such sheet conveying apparatus of the related art and the image forming apparatus having the same, the sheet is obliquely conveyed toward the abutment reference member by the oblique feed roller located on the most upstream in the sheet conveying direction. In the case of obliquely conveying the sheet by such oblique feed rollers, the sheet is obliquely conveyed by one of the oblique feed rollers until it reaches the next oblique feed roller. The sheet is rotated upon the application of the force rotating it toward the abutment reference member. In such rotation of the sheet, the side end of the sheet can collide with the upstream end in the sheet conveying direction of the abutment reference member before the side end of the sheet moves along the abutment reference member.

When the side end of the thin (less rigid) sheet collides with the upstream end in the sheet conveying direction of the abutment reference member, a collision damage can be caused at the side end of the sheet by the abutment reference member so that skew feeding correction becomes insufficient. The side end of the sheet can be bent due to the caused collision damage, resulting in a jam. In addition, the damage of the side end of the sheet passed without jamming can be a defective as a printed matter. Such phenomenon can easily occur in the sheet in which the length in the sheet conveying direction is shorter than the length in the width direction and the sheet whose fiber orientation is substantially perpendicular to the sheet conveying direction and which lose body in a hot and humid environment. When the nip pressure of the oblique feed rollers is lowered, as in Patent Document 2, the rotation of the sheet cannot be regulated. The same phenomenon occurs in the thin sheet whose fiber orientation is crosswise. In other words, the pressing force onto the abutment reference member can be adjusted by the nip pressure of the oblique feed rollers, but the posture of the sheet cannot be adjusted.

Accordingly, the present invention provides a sheet conveying apparatus and an image forming apparatus which can prevent the side end of a sheet from colliding with the upstream end in the sheet conveying direction of an abutment reference member.

According to the present invention, there is provided a sheet conveying apparatus provided with the following: a first pair of oblique feed rollers which obliquely convey the sheet; a second pair of oblique feed rollers which are arranged on the downstream in the sheet conveying direction of the pair of first oblique feed rollers and obliquely convey the sheet; a reference surface which is arranged along the sheet conveying direction and onto which the side end of the sheet obliquely conveyed by the pair of first oblique feed rollers and the pair of second oblique feed rollers is abutted, thereby correcting skew feeding of the sheet; a pair of conveying rollers which convey the sheet to the pair of first oblique feed rollers so as to be contacted and separated, the sheet conveying speed of the pair of conveying rollers being set to be higher than that of the pair of first oblique feed rollers; a separation mechanism which separates the pair of conveying rollers; and a controlling portion which controls the separation mechanism, wherein the controlling portion controls the pair of conveying rollers so as to be separated by the separation mechanism before the sheet conveyed by the pair of conveying rollers and the pair of first oblique feed rollers reaches the pair of second oblique feed rollers.

According to the present invention, the sheet obliquely conveyed by the oblique feed rollers according to the type of sheet is warped between the oblique feed rollers and the pair of conveying rollers, thereby separating the pair of conveying rollers. The collision of the side end of the sheet with the upstream end in the sheet conveying direction of the abutment reference member can be prevented.

Further features of the present invention will become apparent from the following description of exemplary embodiments with reference to the attached drawings.

DESCRIPTION OF THE EMBODIMENTS

Figure 1:
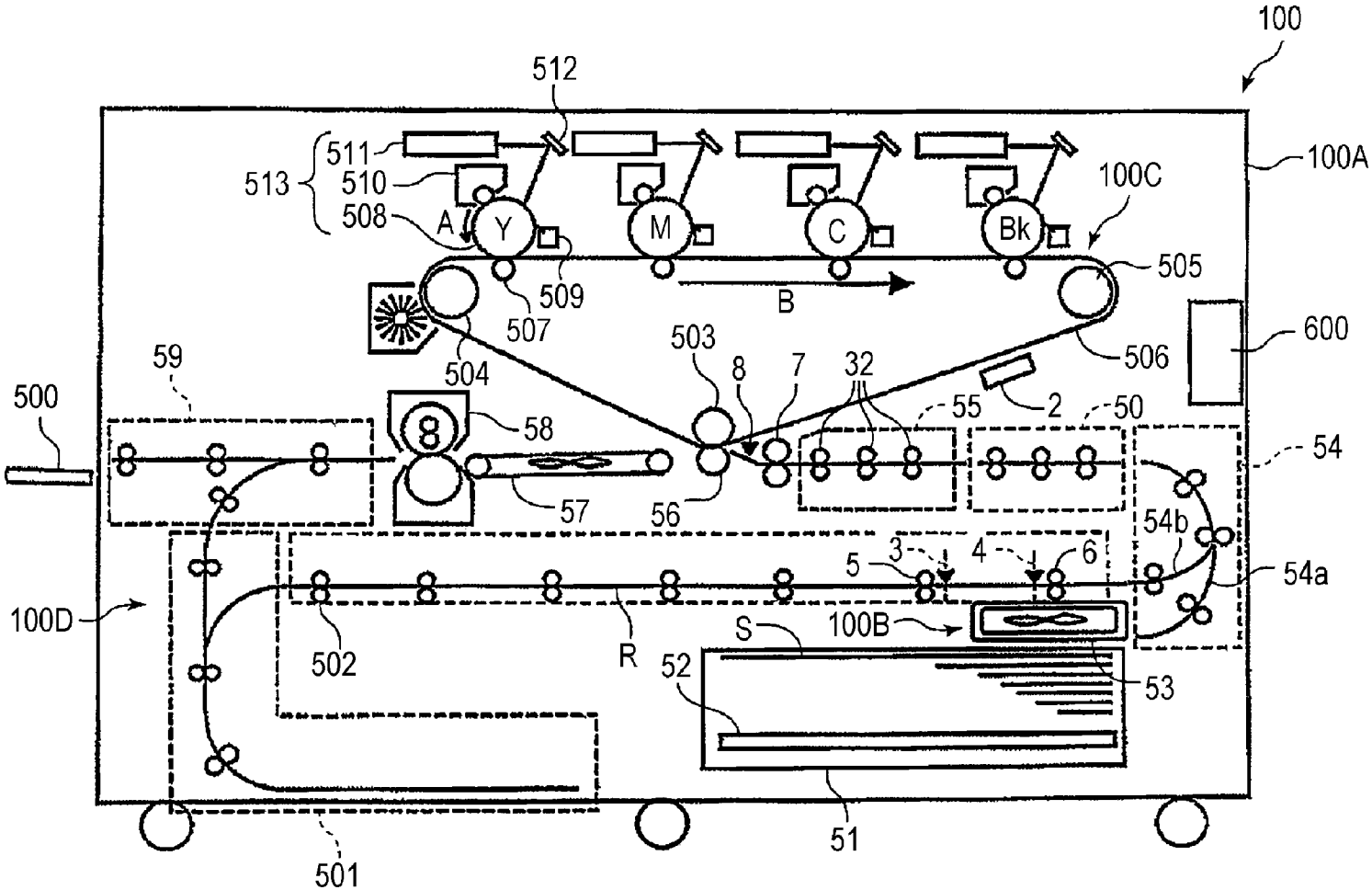
FIG. 1 is a diagram illustrating the schematic configuration of a color image forming apparatus as one example of an image forming apparatus having a sheet conveying apparatus according to an embodiment of the present invention.

An embodiment of the present invention will be described in detail below with reference to the drawings. FIG. 1 is a diagram illustrating the schematic configuration of a color image forming apparatus as one example of an image forming apparatus having a sheet conveying apparatus according to the embodiment of the present invention. FIG. 1 illustrates a color image forming apparatus 100 and a color image forming apparatus body (hereinafter, called an apparatus body) 100A. In terms of configuration, the color image forming apparatus 100 is mainly classified into a tandem system which aligns a plurality of image forming portions and a rotary system which cylindrically arranges them. In addition, the color image forming apparatus 100 is classified into a direct transfer system which directly transfers a toner image onto a sheet from a photosensitive drum and an intermediate transfer system which first transfers the toner image onto an intermediate transfer member and then transfers it onto the sheet. The intermediate transfer system is not required to hold the sheet onto a transfer belt, unlike the direct transfer system, and can respond to various sheets such as a very thick sheet and a coated sheet of paper. From the feature of parallel processing in the image forming portions and full-color image integration transfer, the intermediate transfer system is suitable for realizing high productivity. The color image forming apparatus 50 according to this embodiment has the intermediate transfer tandem system in which image forming units in four colors are aligned on the intermediate transfer belt.

The apparatus body 100A has an image forming portion 513, a sheet feeding portion 100B which conveys a sheet S, and a transfer portion 100C which transfers a toner image formed by the image forming portion 513 onto the sheet S fed by the sheet feeding portion 100B. The apparatus body 100A also has a sheet conveying apparatus 100D which conveys the sheet. The image forming portion 513 includes the image forming units in yellow (Y), magenta (M), cyan (C), and black (Bk), each of them having a photosensitive drum 508, an exposure device 511, a development device 510, a primary transfer device 507, and a cleaner 509. The present invention is not limited to the four colors formed by the image forming units and the color arranging order.

The sheet feeding portion 100B has a sheet storage portion 51 which stacks and stores the sheet S onto a liftup device 52, and a sheet feeding unit 53 which feeds out the sheet S stored in the sheet storage portion 51. The sheet feeding unit 53 includes the system which uses friction separation by a sheet feeding roller, and the system which uses separation and absorption by air. In this embodiment, the sheet feeding system by air is taken as an example. The transfer portion 100C has an intermediate transfer belt 506 wound around rollers such as a driving roller 504, a tension roller 505, and a secondary transfer inside roller 503 and conveyed and driven in the direction indicated by the arrow B in the drawing.

The toner image formed on the photosensitive drum is transferred onto the intermediate transfer belt 506 by a predetermined pressing force and electrostatic load bias applied from the primary transfer device 507. The intermediate transfer belt 506 absorbs an unfixed image to the sheet S by the application of a predetermined pressing force and electrostatic load bias in a secondary transfer portion formed by the secondary transfer inside roller 503 and a secondary transfer outside roller 56 which are substantially opposite. The sheet conveying apparatus 100D has a conveying unit 54, a conveying roller device 50 configuring a conveying roller portion, a skew feeding correction device 55 configuring a skew feeding correction portion, a registration roller 7, a pre-fixing conveying portion 57, a branching conveying device 59, a reversing conveying device 501, and a duplex conveying device 502. In FIG. 1, a controller 600 is a controlling portion which controls the image forming operation and the later-described sheet skew feeding correction operation of the color image forming apparatus 100.

When the image is formed in the color image forming apparatus 100 having such configuration, the photosensitive drum 508 is rotated in the direction indicated by the arrow A in the drawing to uniformly charge the surface of the photosensitive drum by a charging portion, not illustrated. The exposure device 511 emits a light in conformity with a transmitted image information signal. The light irradiates the rotating photosensitive drum 508 via a reflection portion 512, as needed, to form a latent image on the photosensitive drum 508. The remaining transfer toner which slightly remains on the photosensitive drum 508 is collected by the cleaner 509 for the next image formation.

The electrostatic latent image formed on the photosensitive drum 508 is subjected to toner development by the development device 510 to form the toner image on the photosensitive drum. A predetermined pressing force and electrostatic load bias are applied from the primary transfer device 507 to transfer the toner image onto the intermediate transfer belt 506. Image formation by the image forming units in Y, M, C, and Bk of the image forming portion 513 is performed at the timing at which the toner image is superimposed with the upstream toner image primarily transferred onto the intermediate transfer belt. Finally, the full-color toner image is formed on the intermediate transfer belt 506.

The sheet S is fed by the sheet feeding unit 53 in sync with the image forming timing of the image forming portion 513. The sheet S passes through a conveying path 54*a* provided in the conveying unit 54 and is then conveyed to the skew feeding correction device 55 which corrects displacement and skew feeding of the sheet which is being conveyed. The sheet S whose displacement and skew feeding are corrected by the skew feeding correction device 55 is conveyed to the registration roller 7 so as to be subjected to timing correction by the registration roller 7. The sheet S is then conveyed to the secondary transfer portion formed by the secondary transfer inside roller 503 and the secondary transfer outside roller 56. Thereafter, the full-color toner image is secondarily transferred onto the sheet S by the secondary transfer portion. The sheet S onto which the toner image is secondarily transferred is conveyed to a fixing device 58 by the pre-fixing conveying portion 57. The fixing device 58 applies a predetermined pressing force by the substantially opposite rollers or the belt, or typically, the heating effect of a heat source such as a heater, to meltably fix the toner image on the sheet S.

The sheet S having the obtained fixed image is directly discharged onto a sheet discharge tray 500 by the branching conveying device 59. When the image is formed on both sides of the sheet S, the sheet S is conveyed to the reversing conveying device 501 by the switching of a switching member, not illustrated. The leading and trailing ends of the sheet S conveyed to the reversing conveying apparatus 501 are switched by performing the switchback operation so that the sheet S is conveyed to a re-conveying path R provided in the duplex conveying device 502. The sheet S is in sync with and is joined to the following job sheet conveyed from the sheet feeding portion 100B at a re-sheet feeding path 54*b* of the sheet conveying unit 54 so as to be conveyed to the secondary transfer portion. The image forming process of the other side of the sheet S is the same as that of one side of the sheet S and the description is omitted. A large number of conveying rollers are arranged on the conveying unit 54, the branching conveying device 59, the reversing conveying device 501, and the duplex conveying device 502. In the conveying rollers, the sheet is nipped between the driving roller and the driven roller and is conveyed by the rotation of the driving roller and the driven roller. In addition, in the conveying rollers, the driven roller is biased to the driving roller by a biasing member such as a spring, not illustrated, to set a pressure which nips the sheet between both the rollers.

Figure 2:
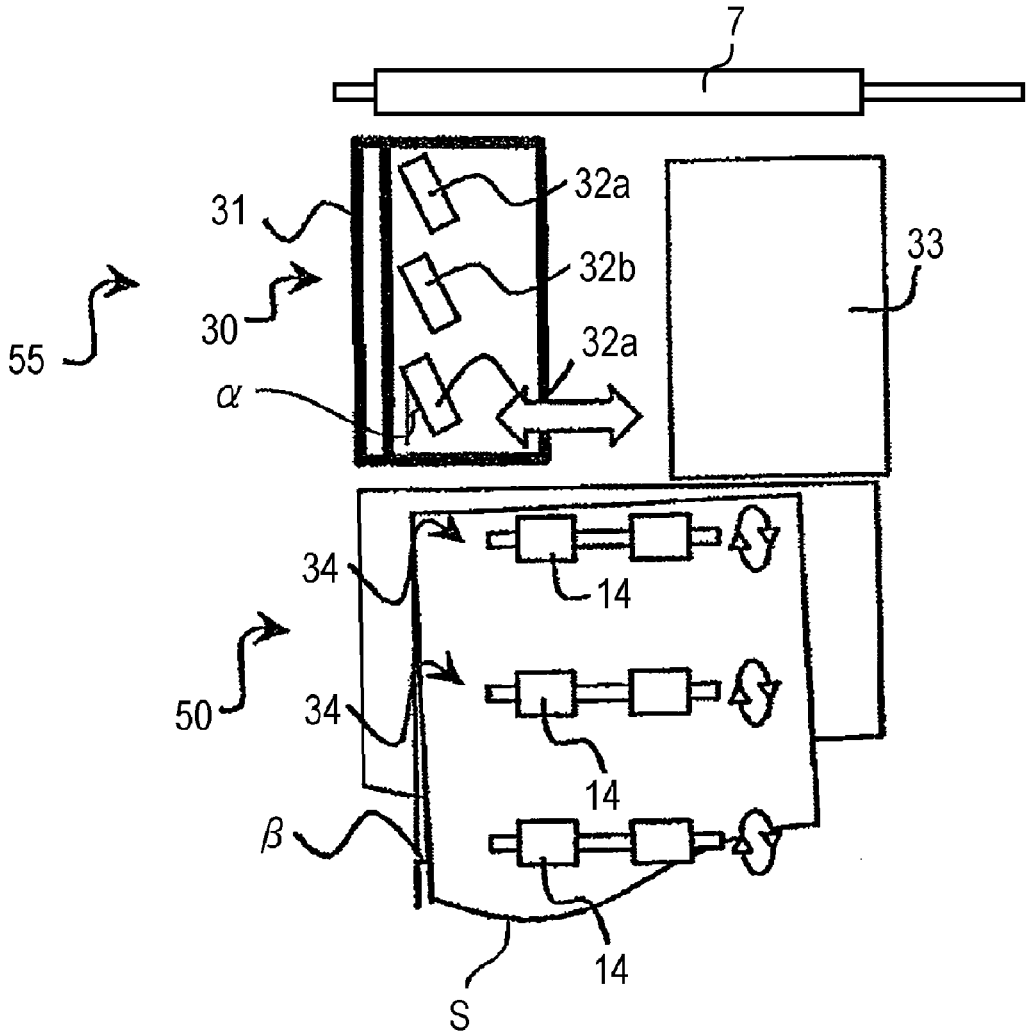
FIG. 2 is a plan view describing the configuration of a skew feeding correction device and a conveying roller device provided in the sheet conveying apparatus.

In this embodiment, the skew feeding correction device 55 which corrects displacement and skew feeding of the sheet which is being conveyed has the correction system according to the side registration reference which corrects displacement of the sheet with reference to the side end of the sheet which is being conveyed. As illustrated in FIG. 2, the skew feeding correction device 55 has a stationary type guide 33 which functions as the conveying guide of the sheet S, and a movable type guide 30 which is movable in the width direction indicated by the arrow (the direction orthogonal to the sheet conveying direction) according to the size of the sheet S conveyed. The movable type guide 30 has a plurality of pairs of oblique feed rollers 32*a* to 32*c*, and an abutment reference member 31 onto which the sheet S obliquely conveyed by the pairs of oblique feed rollers 32*a* to 32*c* is abutted and disposed perpendicularly. The pairs of oblique feed rollers 32*a* to 32*c* are attached to the movable type guide 30 so as to be inclined at an angle $\alpha$ with respect to the sub-scanning direction so as to obtain abutment conveying component with respect to the abutment reference member 31 (hereinafter, called the reference member) which positions the side end of the sheet.

Figure 3A:
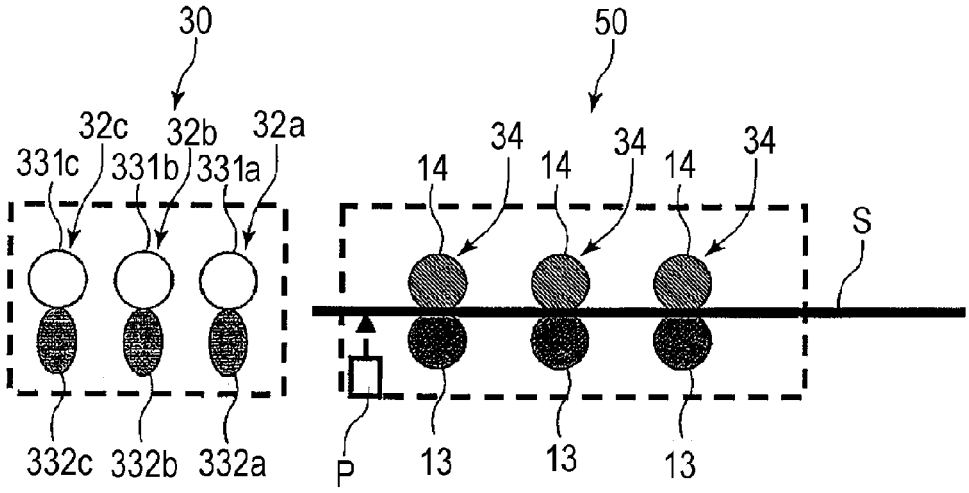
FIGS. 3A and 3B are side views describing the configuration of the skew feeding correction device and the conveying roller device.
Figure 3B:
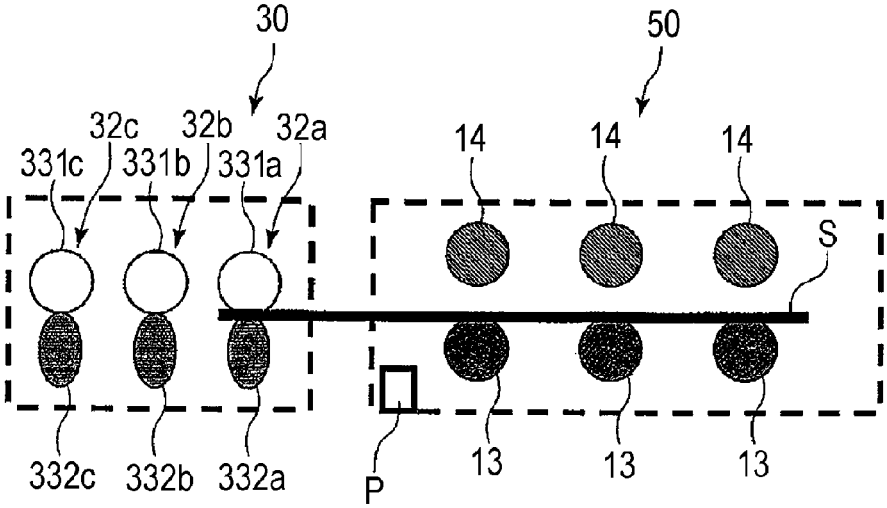

As illustrated in FIG. 2, the conveying roller device 50 which is arranged on the upstream in the sheet conveying direction of the skew feeding correction device 55 and conveys the sheet to the skew feeding correction device 55 has a plurality of pairs of conveying rollers 34. As illustrated in FIGS. 3A and 3B, the conveying rollers 34 of each pair have a rubber driving roller 13 as a lower roller, and a resin driven roller 14 as an upper roller which is pressed onto the driving roller 13 so as to be contacted and separated and, together with the driving roller 13, conveys the sheet. In FIGS. 3A and 3B, a pre-registration sensor P is of an optical type, and has a light emitting portion and a light receiving portion. A light reflected on the passed sheet S is detected by the light receiving portion to detect the passing timing of the sheet. When the leading end of the sheet S passes through the pre-registration sensor P, the pairs of conveying rollers 34 are stopped once to adjust the variation of the sheet conveying time (the distance between sheets). After the variation of the sheet conveying time (the distance between sheets) is adjusted, the rotation of the pairs of conveying rollers 34 is restarted to convey the sheet to the skew feeding correction device 55.

Figure 4A:
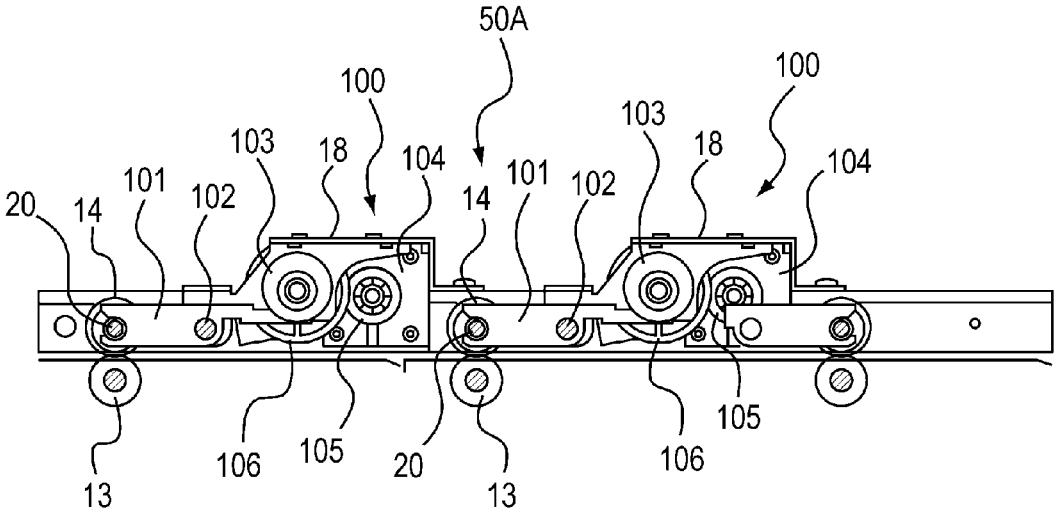
FIGS. 4A and 4B are diagrams describing a separation mechanism of a pair of conveying rollers.
Figure 4B:
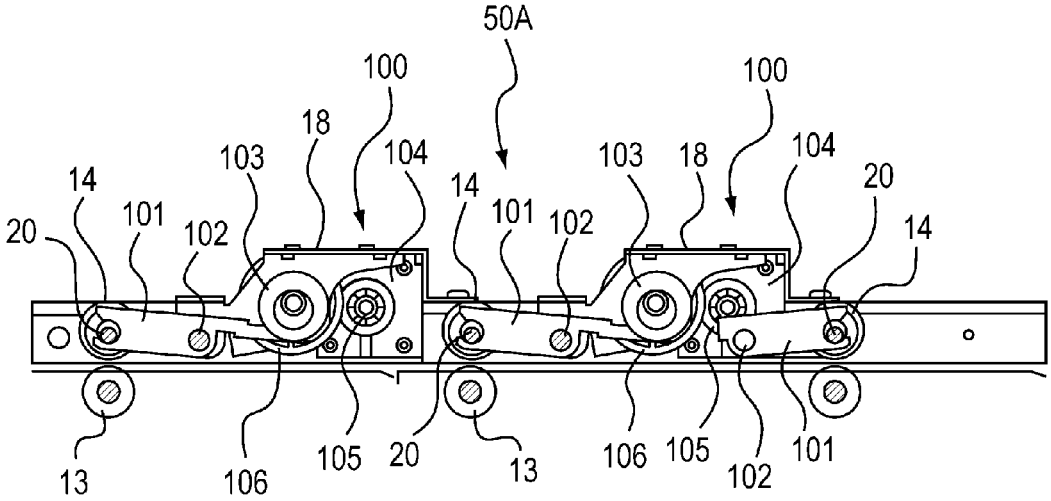

FIGS. 4A and 4B are diagrams describing the configuration of a separation mechanism 50A which separates the pair of conveying rollers 34. Each of the driven rollers 14 is rotatably supported by an arm member 101 via a driven shaft 20. The arm member 101 is swingably supported by a stay member 18 via a swinging shaft 102. When the pair of conveying rollers 34 are separated, a pre-registration pressure releasing motor 104 is rotated, an eccentric roller 103 is rotated via gear trains 105 and 106, and the end of the arm member 101 is pressed by the eccentric roller 103. The arm member 101 in the position illustrated in FIG. 4A is rotated about the swinging shaft 102 in the nip releasing direction. As illustrated in FIG. 4B, the driven roller 14 is raised to release the nip between the driven roller 14 and the driving roller 13. In other words, the pair of conveying rollers 34 are separated. In this embodiment, the pre-registration pressure releasing motor 104 is driven in sync with the detection timing of the pre-registration sensor P to vary the timing of nip release.

Figure 5:
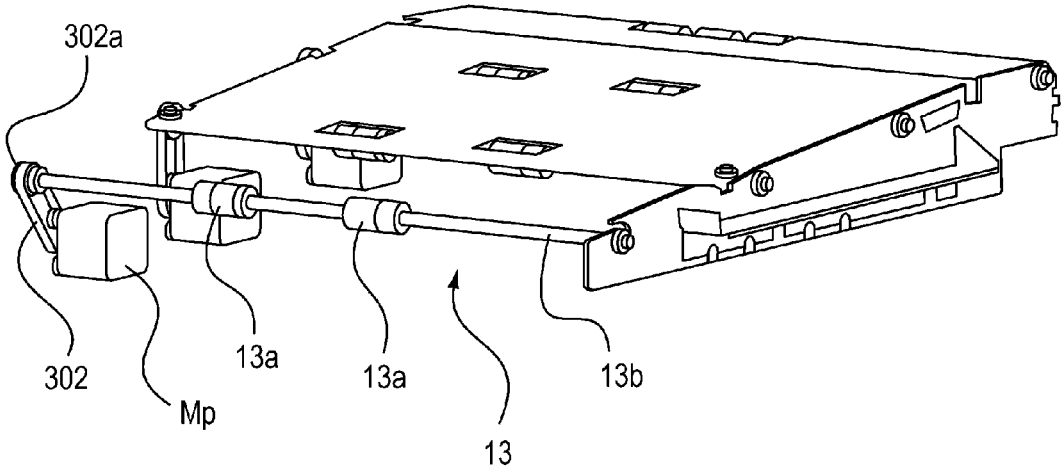
FIG. 5 is a diagram describing the driving portion of a driving roller.

FIG. 5 is a diagram describing the driving portion of the driving roller 13. In the driving roller 13, the driving from a pre-registration motor Mp is transmitted via a pulley 302*a* and a belt 302 to a roller shaft 13*b* to which driving rubber rollers 13*a* are fixed. The pre-registration motor Mp as the driving portion which drives the driving roller 13 is a stepping motor. The stop timing and the conveying speed are varied in sync with the timing of the pre-registration sensor P by the pre-registration motor Mp.

Upon the conveyance of the sheet S conveyed from the conveying unit 54, the driven rollers 14 are in the position where they are pressed onto the driving rollers 13, as illustrated in FIG. 3A. The sheet S conveyed from the conveying unit 54 is nipped between the pairs of conveying rollers 34 and is then conveyed to the skew feeding correction device 55 having the pairs of oblique feed rollers 32*a* to 32*c*. After the sheet S reaches the pair of first oblique feed rollers 32*a* on the most upstream in the sheet conveying direction of the skew feeding correction device 55 and before the sheet S reaches the pair of second oblique feed rollers 32*b* on the downstream, the driven rollers are separated from the driving rollers 13, as illustrated in FIG. 3B. When the driven rollers 14 are separated to release the nip between the driven rollers 14 and the driving rollers 13, the interference of the pairs of conveying rollers 34 with the sheet S obliquely conveyed by the pairs of oblique feed rollers 32*a* to 32*c* can be prevented.

As illustrated in FIGS. 3A and 3B, the pairs of first to third oblique feed rollers 32*a* to 32*c* of the skew feeding correction device 55 have driving rollers 332*a* to 332*c*, and driven rollers 331*a* to 331*c* which are pressed onto the driving rollers 332*a* to 332*c* so as to be contacted and separated and convey the sheet S. As already described, the driving rollers 332*a* to 332*c* are attached to the movable type guide 30 so as to be inclined at the angle α with respect to the sub-scanning direction. The registration roller 7 has a driving roller, and a driven roller which is pressed onto the driving roller so as to be contacted and separated and, together with the driving roller, conveys the sheet.

Figure 6:
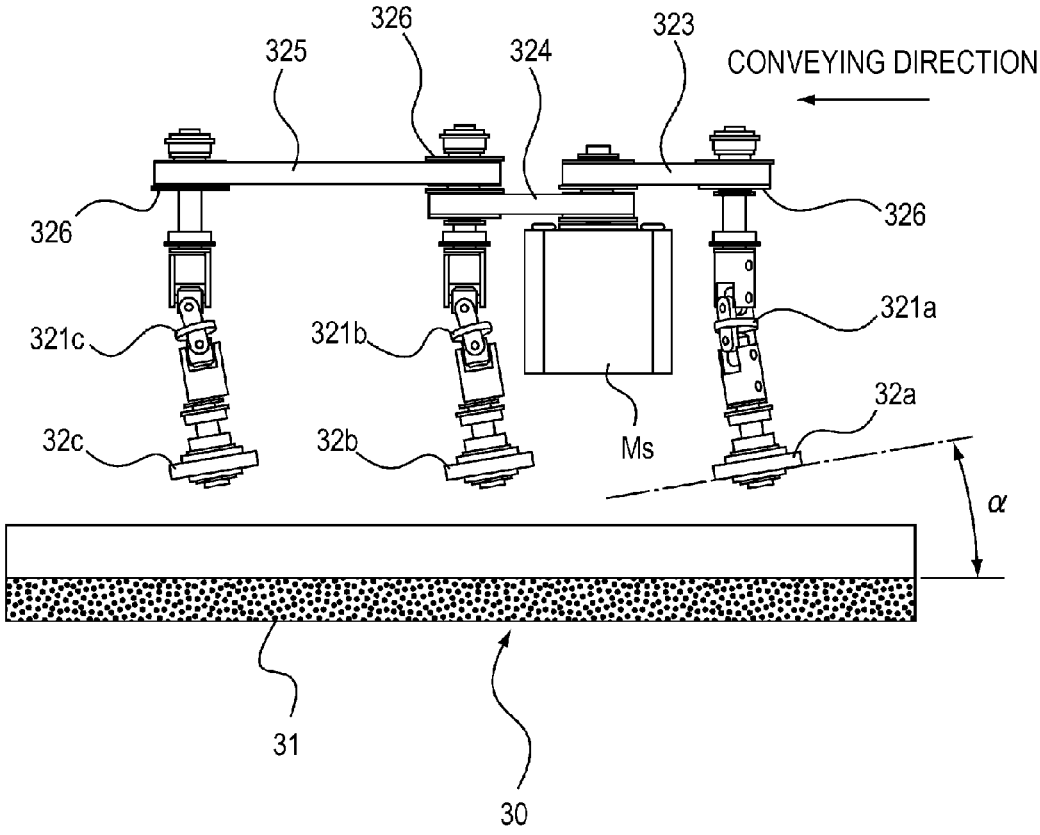
FIG. 6 is a top view of the driving portion which drives pairs of oblique feed rollers of the skew feeding correction device.
Figure 7A:
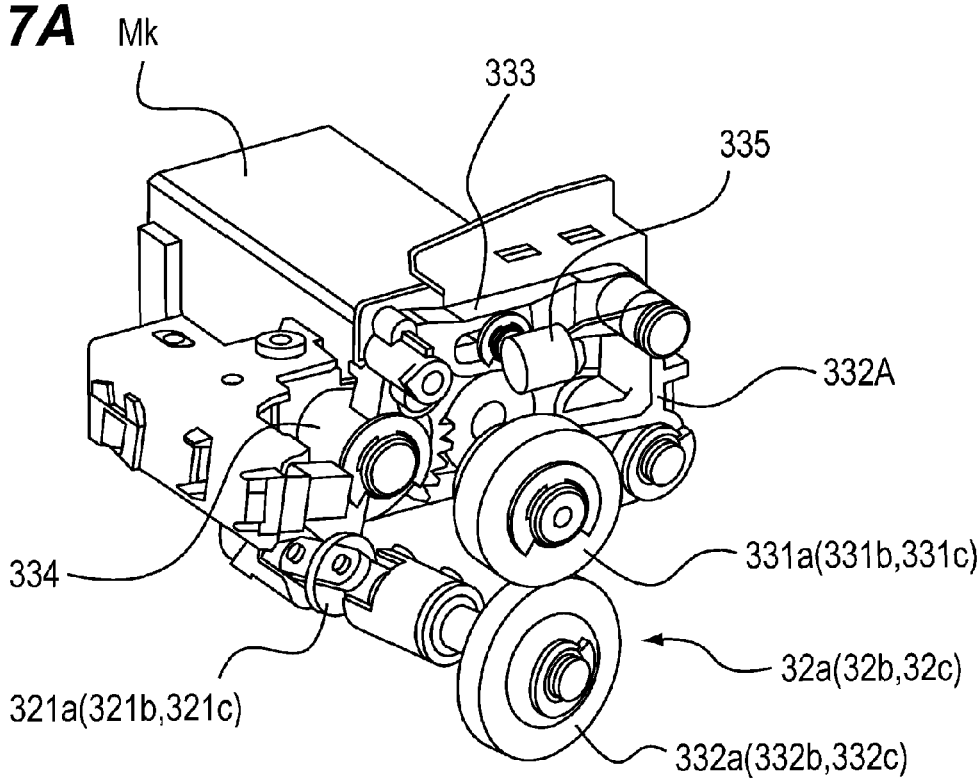
FIGS. 7A and 7B are diagrams describing the moving mechanism of driven rollers configuring the pairs of oblique feed rollers.
Figure 7B:
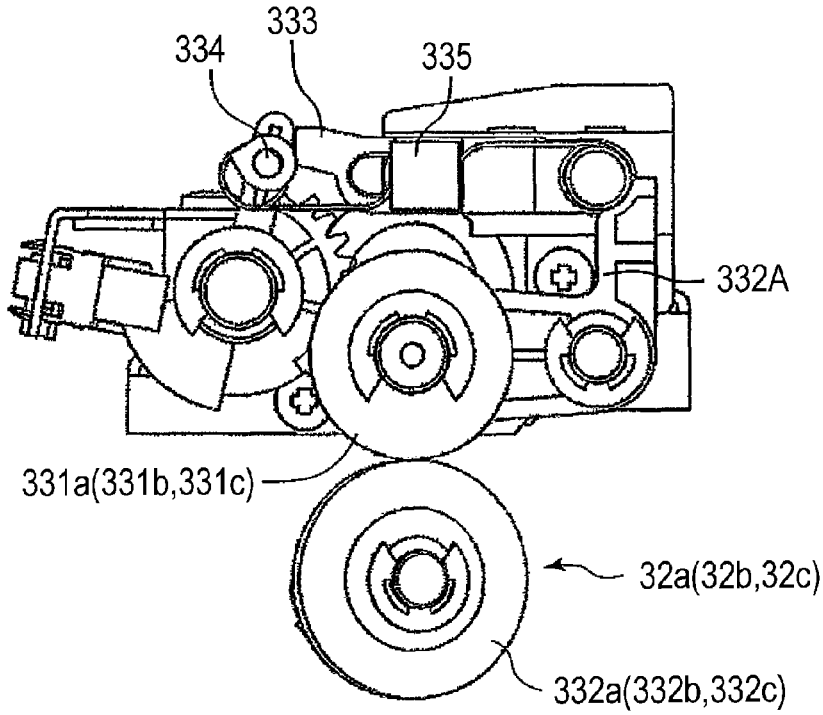

FIG. 6 is a top view of the driving portion of the pairs of first to third oblique feed rollers 32*a* to 32*c* which drive the first to third oblique feed rollers 32*a* to 32*c* provided in the movable type guide 30. The first to third oblique feed rollers 32*a* to 32*c* are arranged at the angle α with respect to the reference member 31 and are driven by a oblique feed driving motor Ms via universal joints 321*a* to 321*c*, pulleys 326, and conveying belts 323 to 325. The oblique feed driving motor Ms is a stepping motor and can vary the conveying speed and set the variable timing. FIGS. 7A and 7B are diagrams describing the moving mechanism of the driven rollers 331*a* to 331*c* which are provided on the driving rollers 332*a* to 332*c* so as to be contacted and separated and, together with the driving rollers 332*a* to 332*c*, nip the sheet. The moving mechanism has a link 332A which rotatably supports the driven rollers 331*a* to 331*c*, a pressing gear 334, a pressing spring 335 provided between the link 332A and the pressing gear 334, and a oblique feed pressing motor Mk which rotates the pressing gear 334. The pressing gear 334 is rotated by the oblique feed pressing motor Mk at a predetermined angle to set the nip pressure of the sheet between the driven rollers 331*a* to 331*c* and the driving rollers 332*a* to 332*c*.

Figure 8A:
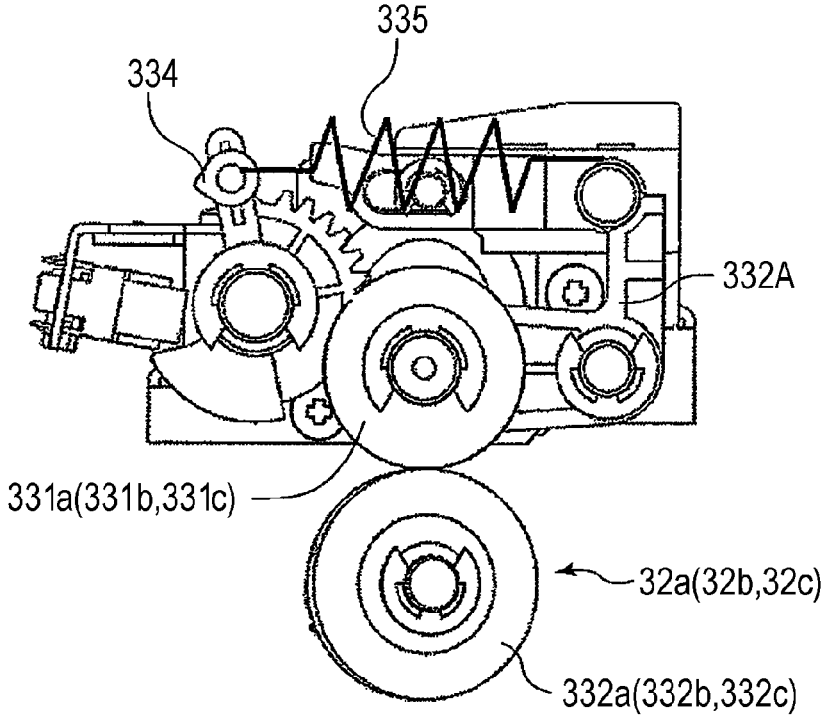
FIGS. 8A and 8B are diagrams describing the operation of the moving mechanism of the driven rollers.
Figure 8B:
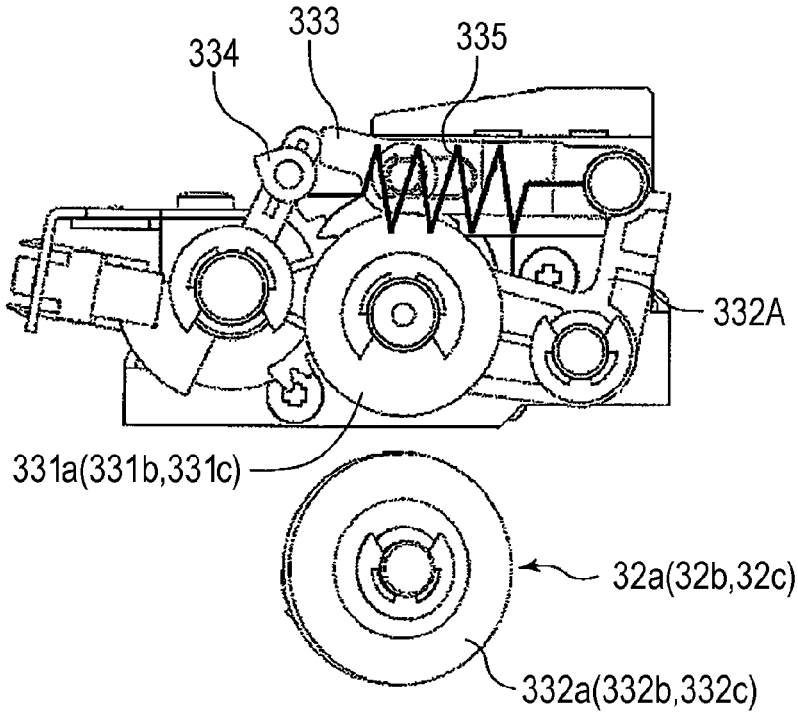

FIG. 8A illustrates the state that the driven rollers 331*a* to 331*c* are pressed onto the driving rollers 332*a* to 332*c*. The pressing gear 334 is rotated to the left and is stopped in the state of pulling a pressing spring 335. The link 332A is pulled by the pressing gear 334 via the pressing spring 335. By pulling the link 332A, the driven rollers 331*a* to 331*c* are pressed onto the driving rollers 332*a* to 332*c*. FIG. 8B illustrates the state of the nip release in which the pressing gear 334 is rotated to the right and is stopped. When the pressing gear 334 is rotated to the right, the pressing gear 334 pushes in the link 332A via the link 333. By pushing in the link 332A, the driven rollers 331*a* to 331*c* are moved in the direction releasing the nip (upward). The oblique feed pressing motor Mk is a stepping motor and can change the nip pressure of the pairs of oblique feed rollers 32*a* to 32*c* by setting a step angle. In this embodiment, the moving mechanism is provided in the driven rollers 331*a* to 331*c*. The nip pressure of the pairs of oblique feed rollers 32*a* to 32*c* can be independently set.

Figure 9A:
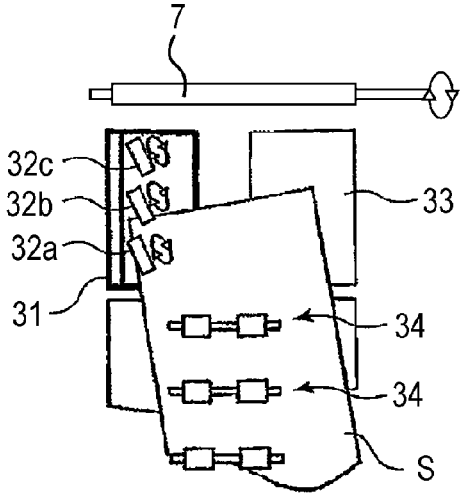
FIGS. 9A, 9B, and 9C are diagrams describing the operation of the skew feeding correction device and the conveying roller device.

The operation of the thus-configured conveying roller device 50 and skew feeding correction device 55 at the time of sheet conveyance will be described. As illustrated in FIG. 2, when the sheet S having a skew feeding angle β is conveyed from the conveying unit 54 to the conveying roller device 50, the sheet S is conveyed to the skew feeding correction device 55 by the pairs of conveying rollers 34. As illustrated in FIG. 9A, the sheet S is nipped by the pairs of oblique feed rollers 32*a* to 32*c* and is obliquely conveyed toward the reference member 31. After the sheet S reaches the pair of first oblique feed rollers 32*a* located on the most upstream in the sheet conveying direction and before the sheet S reaches the pair of second oblique feed rollers 32*b* located on the downstream in the sheet conveying direction of the pair of first oblique feed rollers 32*a*, the nip between the pairs of conveying rollers 34 is released (see FIG. 3B).

Figure 9B:
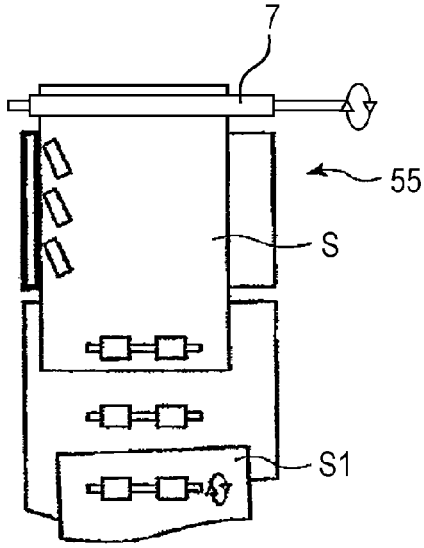

As illustrated in FIG. 9B, the sheet S is conveyed to the registration roller 7 on the downstream while the end face thereof is pressed onto the reference member 31 configuring a reference surface by the pairs of oblique feed rollers 32*a* to 32*c*. By conveying the sheet S whose end face is pressed (abutted) onto the reference member 31, skew feeding and displacement in the width direction of the sheet S are corrected. In this embodiment, in consideration of the variation of the position of the sheet S conveyed in the width direction, when the sheet S is conveyed by the skew feeding correction device 55, the reference member 31 is standby in the offset position, whereby the sheet S conveyed to the skew feeding correction device 55 cannot collide with it.

Figure 9C:
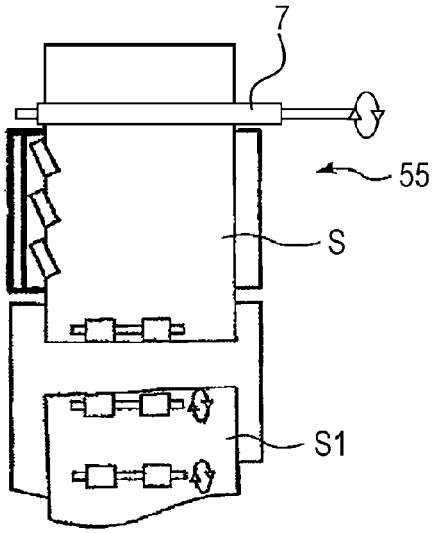

The sheet S reaches the registration roller 7 to start the conveyance of the sheet S by the registration roller 7. As illustrated in FIG. 9C, the registration roller 7 moves in the width direction indicated by the arrow while nipping and conveying the sheet S. This can align the sheet S and the center position of the image on the intermediate transfer belt. Before the registration roller 7 moves in the width direction, the pairs of oblique feed rollers 32*a* to 32*c* are separated. This can prevent the interference of the pairs of oblique feed rollers 32*a* to 32*c* with the movement of the sheet S with the movement of the registration roller 7. After the sheet S is conveyed to the secondary transfer portion, the registration roller 7 is moved in the opposite direction of the arrow illustrated in FIG. 9C to return to the standby state in order to release the nip and convey the next sheet S1.

Figure 10:
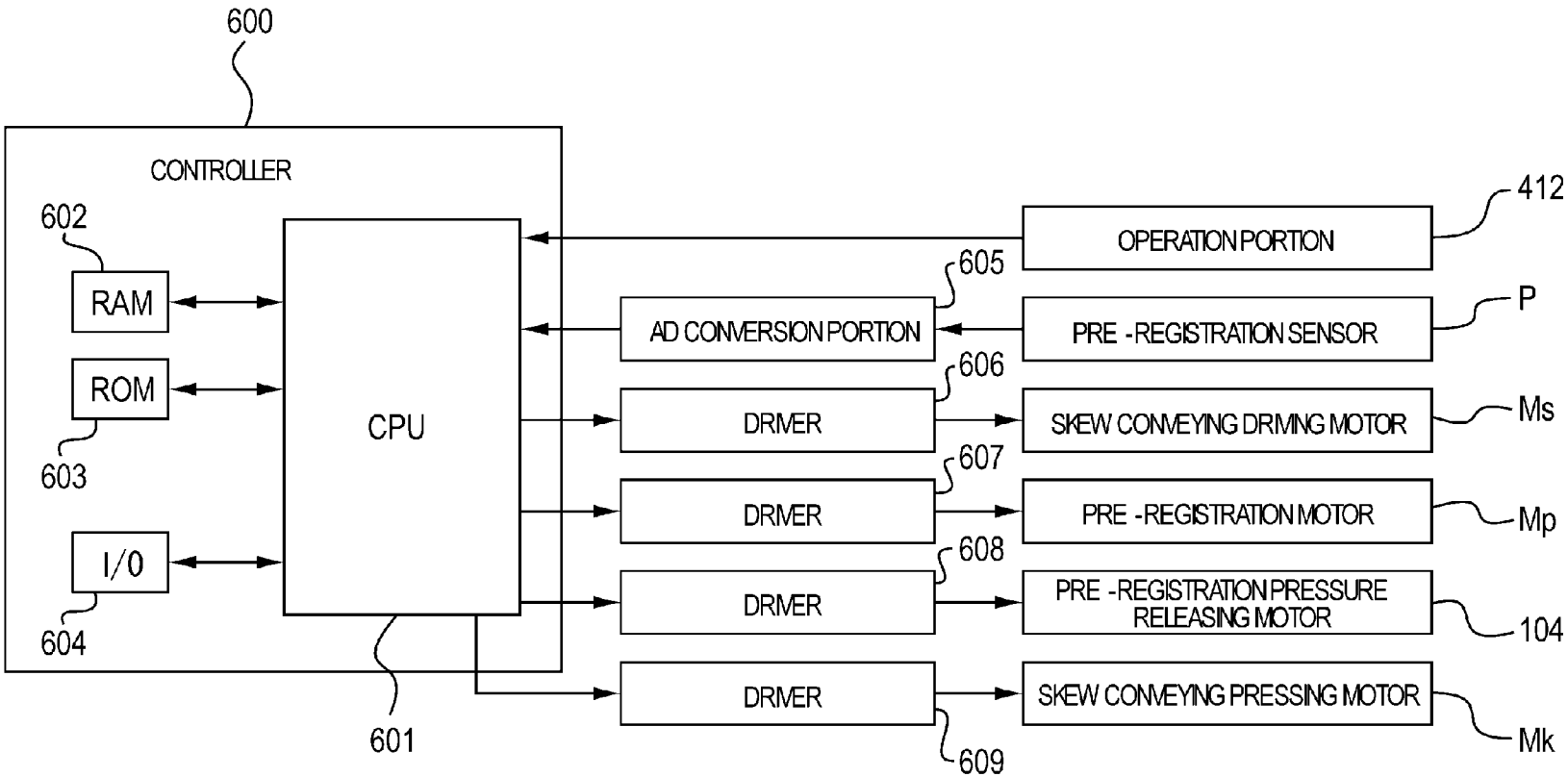
FIG. 10 is a control block diagram of a controller provided in the color image forming apparatus.

FIG. 10 is a control block diagram of the controller 600. The controller 600 has a CPU 601, a ROM 603 which stores programs, a RAM 602 which temporarily stores data, and an I/O 604 for communication. The size, the number of sheets, and fiber orientation information of the sheet S used are inputted from an operation portion 412 by the user to identify the size, the number of sheets, and fiber orientation of the sheet S. The controller 600 controls the driving of the oblique feed driving motor Ms, the pre-registration motor Mp, the pre-registration pressure releasing motor 104, and the oblique feed pressing motor Mk via drivers 606 to 609 by a timing signal obtained by the pre-registration sensor P via an AD conversion portion 605. This controls the driving of the pairs of oblique feed rollers 32*a* to 32*c*, the nip pressure of the driven rollers 331*a* to 331*c* with respect to the driving rollers 332*a* to 332*c*, the driving of the conveying rollers 13, and the releasing operation of the driven rollers 14.

When the sheet S having the skew feeding angle β is conveyed to the skew feeding correction device 55 by the conveying roller device 50, as illustrated in FIG. 2, the sheet S is obliquely conveyed toward the reference member 31 by the pairs of oblique feed rollers 32*a* to 32*c*, as illustrated in FIG. 9A. The controller 600 previously predicts the time at which the pair of first oblique feed rollers 32*a* nip the sheet from the detection timing of the pre-registration sensor P, the distance between the pre-registration sensor P and the pair of first oblique feed rollers 32*a*, and the sheet conveying speed of the conveying roller device 50 by calculation. When the pair of first oblique feed rollers 32*a* nip the sheet, as illustrated in FIG. 3B, the driven rollers 14 are separated from the conveying rollers 13 to release the nip of the trailing end of the sheet. Thereafter, the skew feeding correction of the sheet S is started.

Figure 11A:
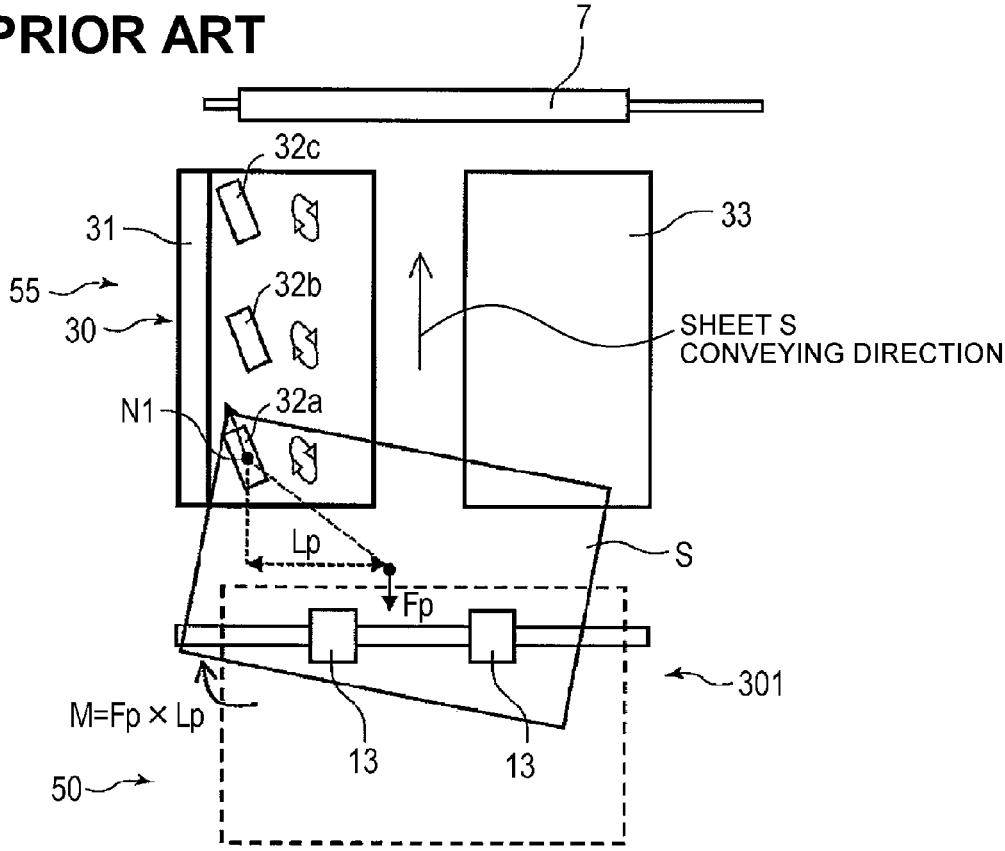
FIG. 11A PRIOR ART
FIGS. 11A and 11B are diagrams describing the behavior of a sheet at the time of the skew feeding correction of the skew feeding correction device of the related art.
Figure 11B:
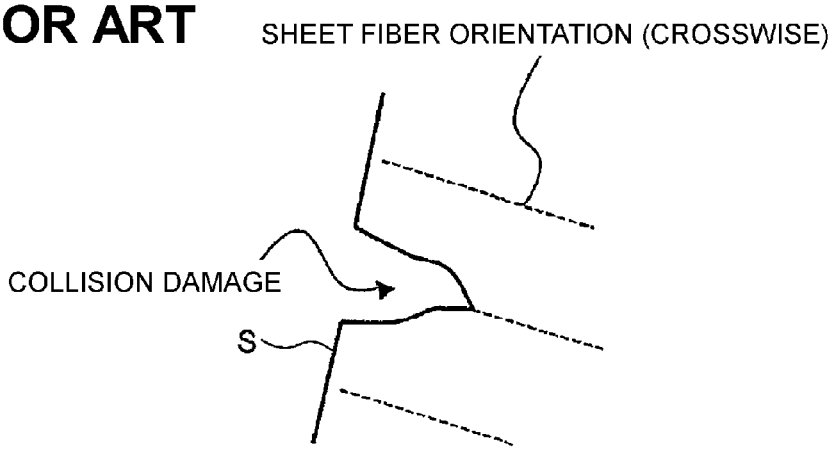
FIG. 11B PRIOR ART

In the skew feeding correction device 55 having such side registration system, in the related art, upon the nip of the sheet by the pair of first oblique feed rollers 32*a*, the driven rollers 14 are separated from the conveying rollers 13. As illustrated in FIG. 11A, the center of gravity of the sheet S is Fp. When conveyed by the pair of first oblique feed rollers 32*a*, the sheet S receives the force of Fp in the opposite direction of the sheet conveying direction. When the distance between the center of gravity and the pair of first oblique feed rollers 32*a* in the width direction is Lp, the moment of M=Fp×Lp is applied to the sheet S. By such moment, the side end of the sheet S is rotated in the direction toward the reference member 31, as indicated by the arrow. The side end of the sheet S collides with the upstream end in the sheet conveying direction of the reference member 31. As illustrated in FIG. 11B, a collision damage is caused at the side end of the sheet S. Due to the collision damage, skew feeding elimination is failed and conveying load is increased, whereby a sheet jam easily occurs before the sheet S reaches the registration roller 7. As illustrated in FIG. 11B, when the fiber orientation of the sheet S is crosswise with respect to the sheet conveying direction, the sheet S is easily torn along the fiber. The side end of the thin sheet having a grammage of 50 g/mm or below can be damaged.

Figure 12A:
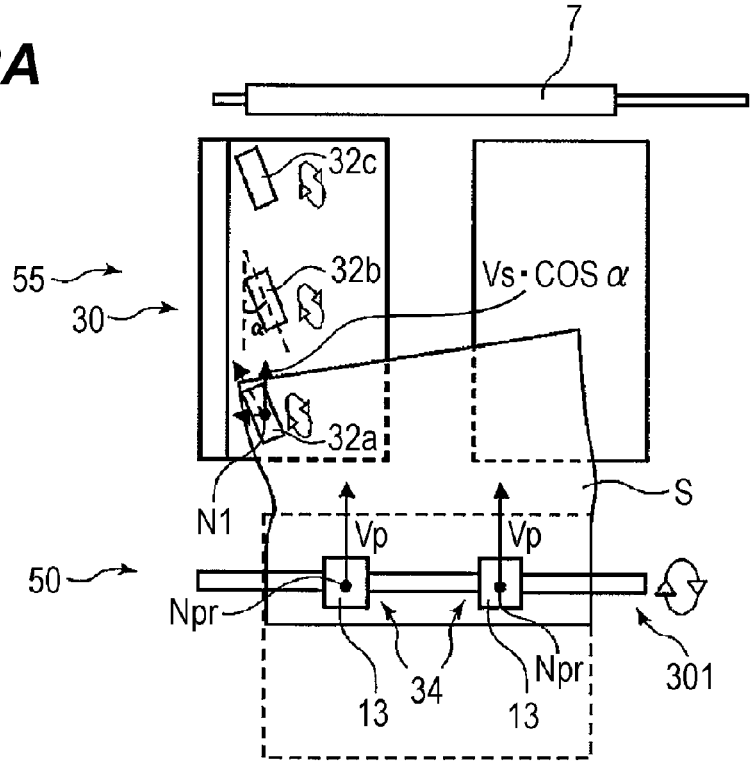
FIGS. 12A and 12B are first diagrams describing the behavior of the sheet at the time of the skew feeding correction of the skew feeding correction device.
Figure 12B:
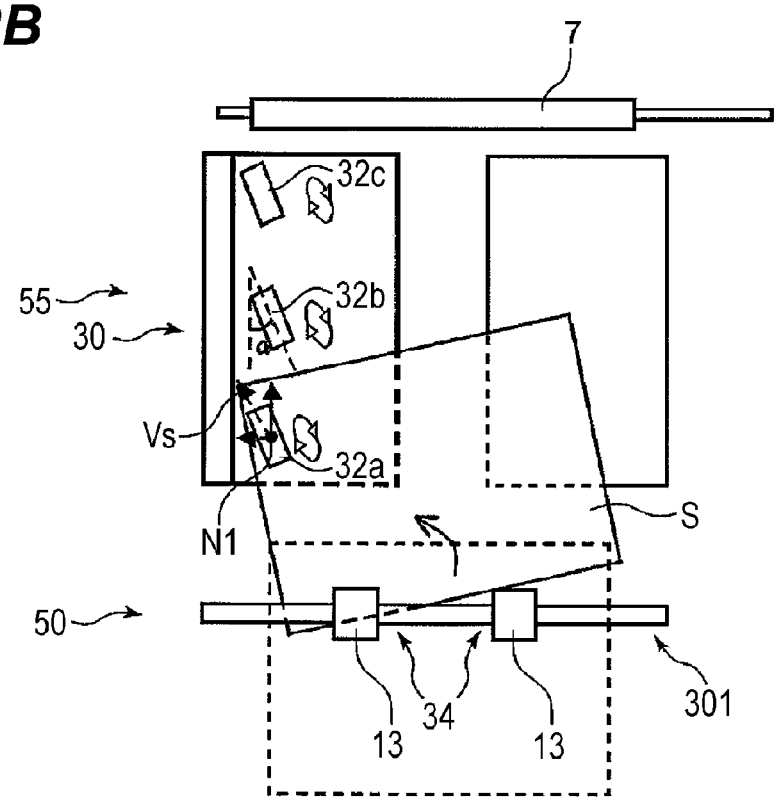

In this embodiment, to prevent the collision of the side end of the sheet with the reference member 31, the sheet conveying speed of the conveying rollers (the pairs of conveying rollers 34) is selectively higher than the sheet conveying speed of the pair of first oblique feed rollers 32*a* according to the type of sheet to convey the sheet S. When the sheet reaches the pair of first oblique feed rollers 32*a* so that the sheet is nipped by the pair of first oblique feed rollers 32*a* and the pairs of conveying rollers 34 at the same time, the sheet is pushed in by the pairs of conveying rollers 34 having a high sheet conveying speed. As illustrated in FIG. 12A, a twisted loop is formed in the sheet. Before the sheet reaches the pair of second oblique feed rollers 32*b*, the pairs of conveying rollers 34 are separated. After the loop is formed in the sheet, the pairs of conveying rollers 34 are separated to eliminate the twisted loop. With this, as illustrated in FIG. 12B, the sheet becomes in the skewed posture in which the side end thereof is separated from the reference member 31 by the restoring force of the rigidity. The sheet is conveyed only by the pair of first oblique feed rollers 32*a*. As illustrated in FIG. 11A, the sheet is rotated in the direction indicated by the arrow.

In order that the side end of the rotated sheet S cannot collide with the reference member 31, the sheet conveying speed of the pair of first oblique feed rollers 32*a* and the pairs of conveying rollers 34 and the timing at which the pairs of conveying rollers 34 are separated are set. These may be determined by an experiment according to the size and type of sheet used or be calculated and the data are stored in the ROM 603. In this embodiment, the sheet conveying speed of the pairs of conveying rollers 34 is selectively increased in accordance with the sheet thickness (rigidity) or the fiber orientation state of the sheets S having the same size and in accordance with the length in the sheet conveying direction of the sheet.

Figure 13:
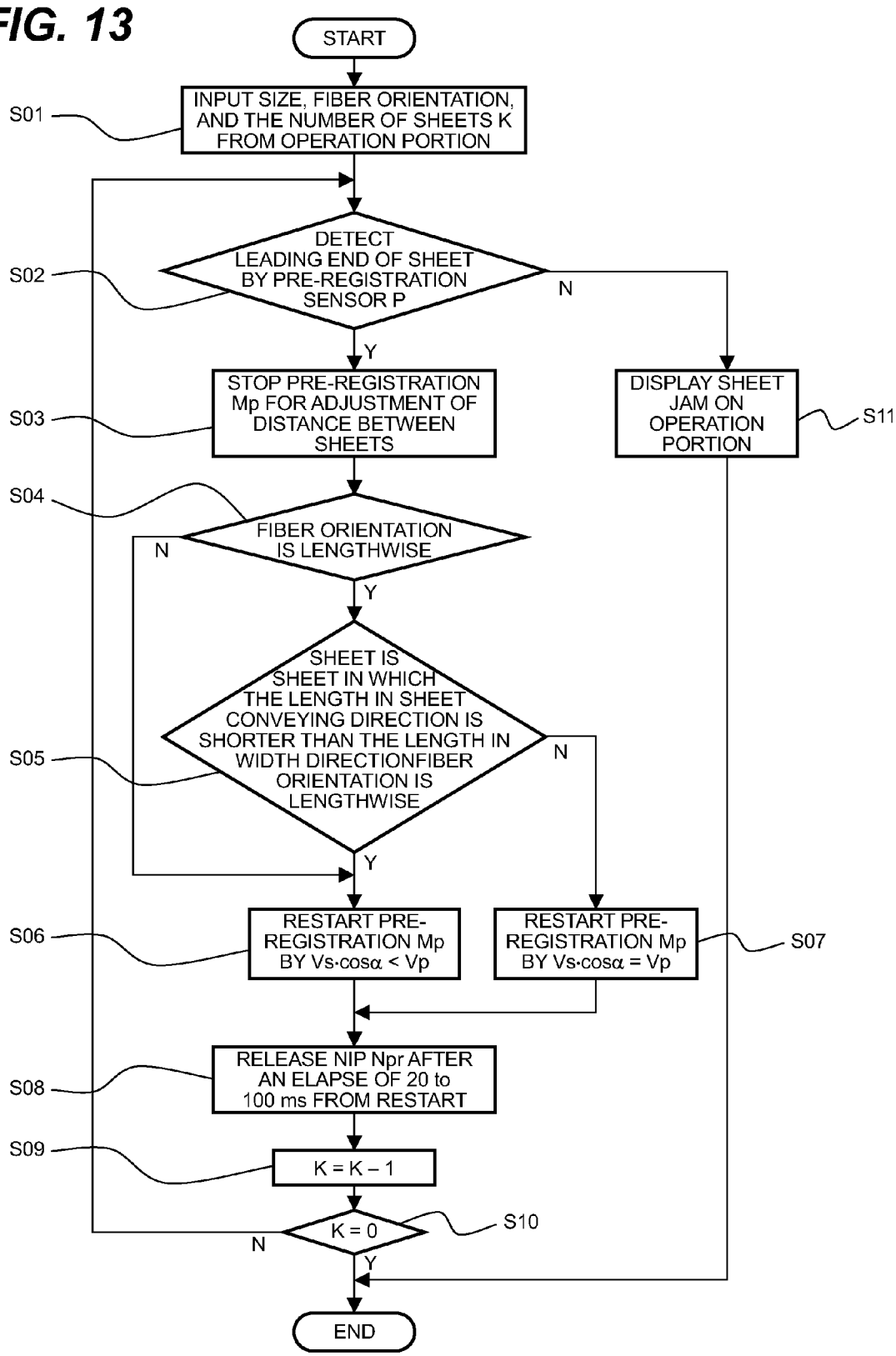
FIG. 13 is a flowchart illustrating the control operation at the time of the skew feeding correction operation of the controller.

The controlling operation at the time of the skew feeding correction operation by the controller 600 will be described with reference to the flowchart illustrated in FIG. 13. The number of sheets passed K, sheet size, and sheet fiber orientation (information) are inputted from the operation portion 412 (S01) to start sheet passage. The sheet S reaches the conveying roller device 50 and the pre-registration sensor P detects the leading end of the sheet (Y of S02). The controller 600 temporarily stops the pre-registration motor Mp (S03) to adjust the time between sheets (the interval of sheets). When the pre-registration sensor P does not detect the leading end of the sheet (N of S02), a sheet jam (delay jam) is displayed on the operation portion 412 (S11) to end the processing. After such adjustment of the time between sheets, the controller 600 restarts the pre-registration motor Mp to convey the sheet S to the skew feeding correction device 55, as illustrated in FIG. 3A.

The controller 600 determines, from the fiber orientation information inputted from the operation portion 412, whether the fiber orientation of the sheet S is crosswise (in the direction perpendicular to the sheet conveying direction) (S04). When the fiber is crosswise, not lengthwise, (N of S04), the pre-registration motor Mp is restarted by speed setting so that a conveying direction component Vs·cos α of a speed Vs of the pair of first oblique feed rollers 32*a* is lower than a speed Vp of the conveying rollers 13. In other words, the pre-registration motor Mp is restarted by speed setting in which Vs·cos α<Vp (S06). When the pre-registration motor Mp is restarted, the conveying rollers 13 nip the sheet by a nip Npr formed together with the driven rollers 14.

In this embodiment, the conveying speed Vp of the conveying rollers 13 is about 600 mm/s and the distance between the pair of first oblique feed rollers 32*a* and the pair of second oblique feed rollers 32*b* is about 70 mm. In this embodiment, until the sheet S is nipped from the pair of first oblique feed rollers 32*a* to the pair of second oblique feed rollers 32*b*, that is, until 116 ms (=70/600) elapses, the pairs of conveying rollers 34 do not release the nip. For the time of the nip between the pairs of conveying rollers 34, the optimum time between 20 ms and 100 ms is set according to the sheet size, grammage, and sheet fiber orientation. In this embodiment, the conveying speed Vp of the conveying rollers 13 is about 6% higher than the speed Vs·cos α of the conveying direction component of the pair of oblique feed rollers 32.

After an elapse of 20 to 100 ms (e.g., 100 ms) before the sheet reaches the pair of second oblique feed rollers 32*b* from the restart of the pre-registration motor Mp, the driven rollers 14 are separated to release the nip Npr, as illustrated in FIG. 4B (S08). When the pairs of conveying rollers 34 form the nip Npr, the pair of first oblique feed rollers 32*a* also form a nip Ns to, together with the pairs of conveying rollers 34, nip the sheet. While the pairs of conveying rollers 34 and the pair of first oblique feed rollers 32*a* nip the sheet at the same time, a twisted loop is formed in the sheet S by the speed setting of Vs·cos α<Vp, as illustrated in FIG. 12A.

Figure 14:
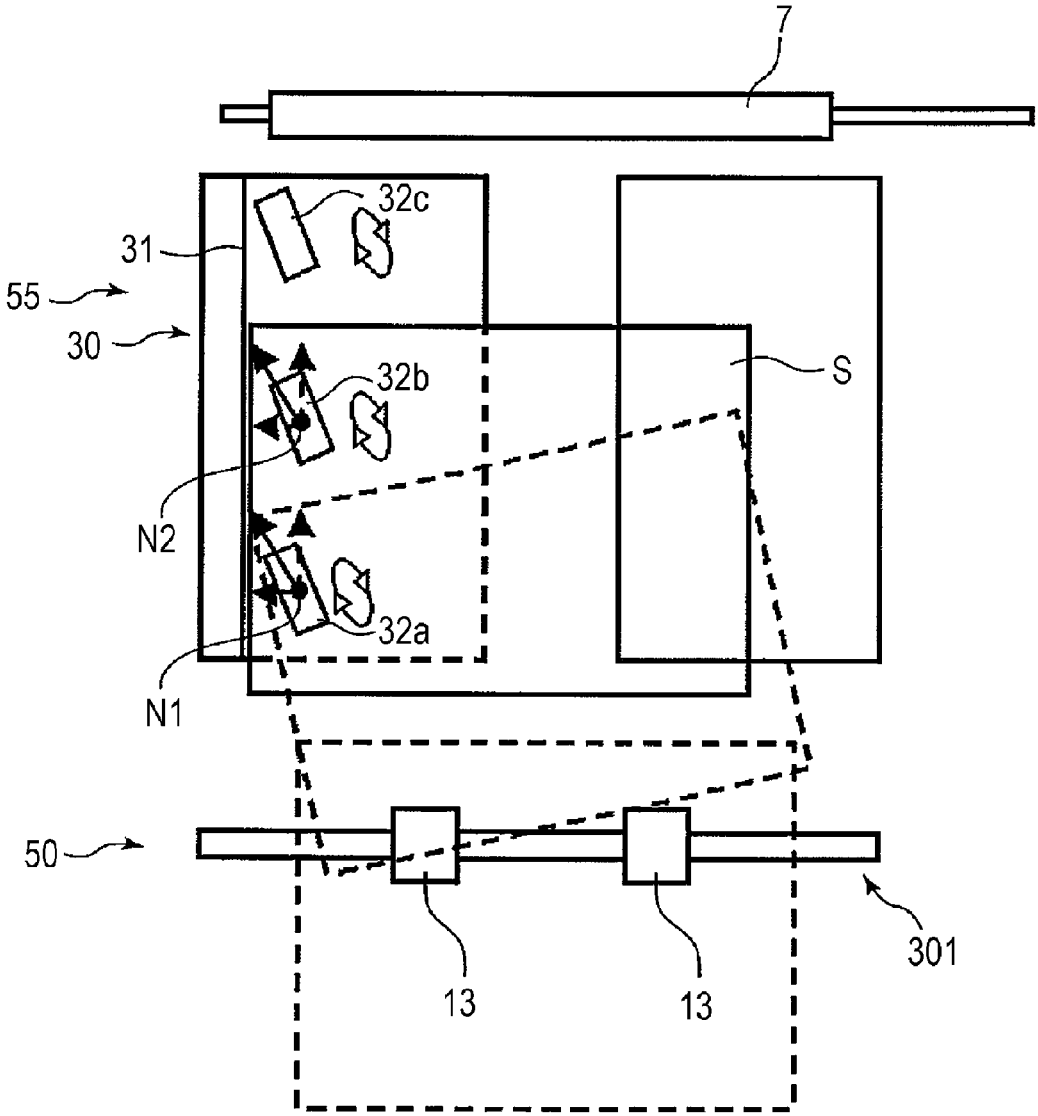
FIG. 14 is a second diagram describing the behavior of the sheet at the time of the skew feeding correction of the skew feeding correction device.

When the driven rollers 14 are raised to release the nip between the pairs of conveying rollers 34, the twisted loop formed in the sheet S is released. As illustrated in FIG. 12B, the posture of the sheet S is skew with respect to the abutment reference direction. As illustrated in FIG. 14, the sheet S is conveyed by the pair of first oblique feed rollers 32*a*. In this case, as illustrated in FIG. 11A, the moment of M=Fp×Lp occurs in the sheet S. In this embodiment, as illustrated in FIG. 12B, the posture of the sheet S is changed to the posture in which the side end of the sheet S is separated from the reference member 31. When the side end of the sheet S is abutted onto the reference member 31, as illustrated in FIG. 14, the sheet S is rotated in substantially parallel with the reference member 31 to abut the side end of the sheet S in substantially parallel with the reference member 31. The side end of the sheet can be smoothly abutted onto the upstream end of the reference member 31 without colliding with it. The occurrence of any collision damage at the side end of the sheet can be prevented.

When the fiber orientation is not crosswise, that is, lengthwise (Y of S04), it is determined whether the sheet is a sheet in which the length in the sheet conveying direction is shorter than the length in the width direction (S05). The sheet in which the length in the sheet conveying direction is shorter than the length in the width direction is affected by the moment M and is easily rotated. When the sheet is a sheet in which the length in the sheet conveying direction is shorter than the length in the width direction (Y of S05), as already described, the pre-registration Mp is restarted by the speed setting of $Vs \cdot \cos \alpha < Vp$ (S06) to push in the trailing end of the sheet S for preventing rotation. When the sheet S is a sheet in which the length in the sheet conveying direction is longer than the length in the width direction, not a sheet in which the length in the sheet conveying direction is shorter than the length in the width direction, the sheet S is hardly affected by the moment M and is hardly rotated. When the sheet S is pushed in from behind by the conveying roller, as described above, the left corner portion of sheet S enters the reference member 31 so that corner folding occurs. When the sheet S is not a sheet in which the length in the sheet conveying direction is shorter than the length in the width direction (N of S05), the pre-registration Mp is restarted by the speed setting of $Vs \cdot \cos \alpha = Vp$ (S07).

The sheet S in which the side end is abutted in substantially parallel with the reference member 31 is nipped and conveyed to the pair of second oblique feed rollers 32*b* and the pair of third oblique feed rollers 32*c*. A sheet passage counter counts K=K−1 (S09). When not K=0 (N of S10), the driven rollers are lowered at the timing at which the sheet alignment of the skew feeding correction device 55 is completed to form the nip Npr of the pairs of conveying rollers 34 for continuous sheet passage. When the sheet passage counter becomes K=0 (Y of S10), the processing is ended.

Figure 15:
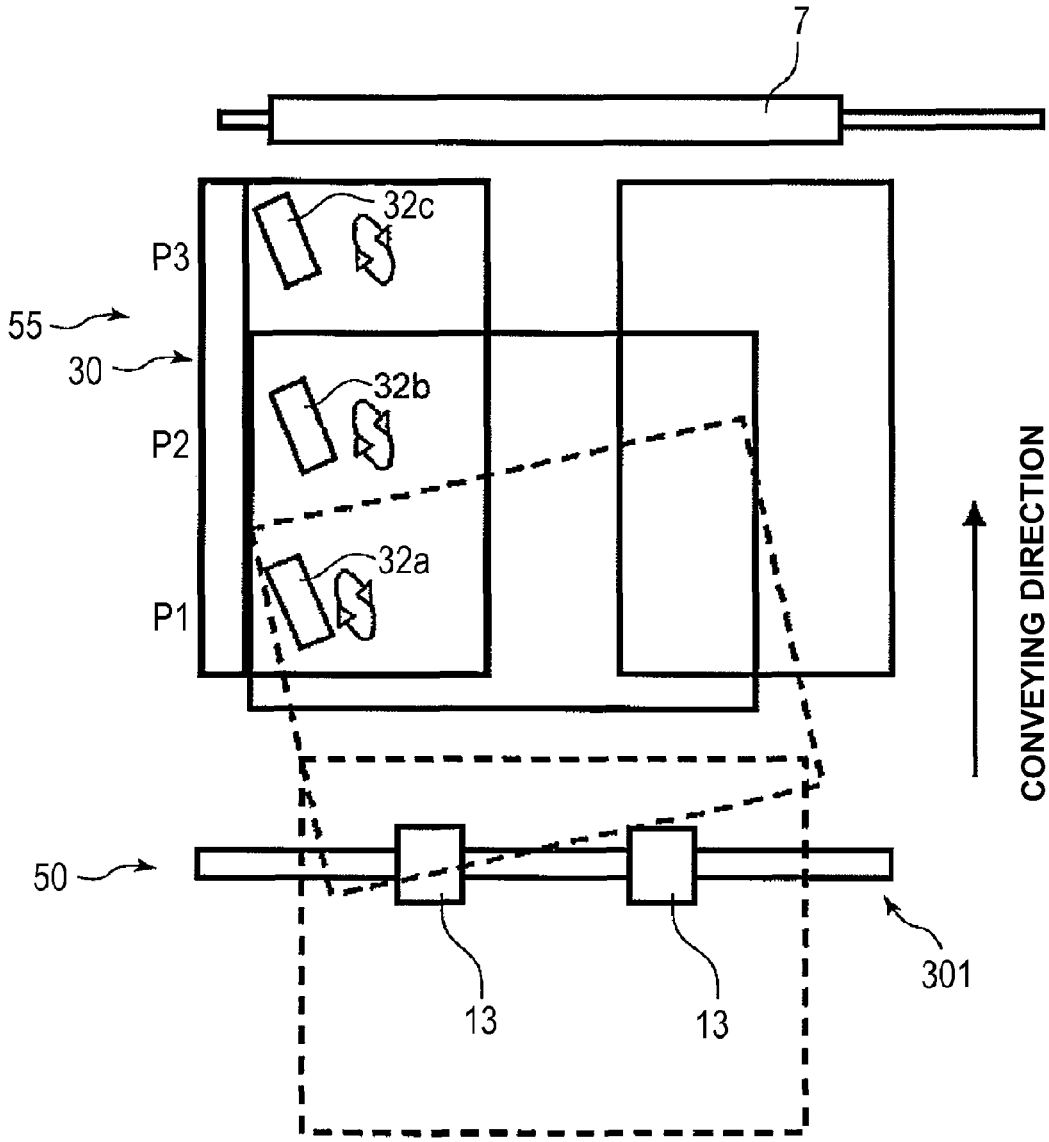
FIG. 15 is a third diagram describing the behavior of the sheet at the time of the skew feeding correction of the skew feeding correction device.

In this embodiment, the nip pressures of the pairs of first to third oblique feed rollers 32*a* to 32*c* are P1 to P3, as illustrated in FIG. 15. The nip pressures P1 to P3 are set to P1≦P2≦P3, that is, the nip pressure is higher toward the oblique feed roller on the downstream in the sheet conveying direction. When the sheet is nipped and conveyed by the pairs of first to third oblique feed rollers 32*a* to 32*c*, in particular, when the sheet is conveyed only by the pair of first oblique feed rollers 32*a*, the pair of first oblique feed rollers 32*a* nip and press the sheet only at one point so that the posture of the sheet is instable. However, when the sheet reaches the pair of second oblique feed rollers 32*b*, the sheet S is nipped and pressed at two points by the pair of first oblique feed rollers 32*a* and the pair of second oblique feed rollers 32*b* so that sheet conveyance is enabled in the stable posture.

The driving rollers 332*a* to 332*c* are rubber rollers and the driven rollers 331*a* to 331*c* are metal bearings. When the driven rollers 331*a* to 331*c* are pressed, the rubber driving rollers 332*a* to 332*c* yield to pressure. When the rubber rollers are rotated at the same speed (angular speed), the sheet nipped by the amount in which the rubber rollers yield to pressure is conveyed faster. In other words, as the nip pressure is higher, the sheet conveying speed is increased. When the nip pressure P2 of the pair of second oblique feed rollers 32*b* is higher than the nip pressure P1 of the pair of first oblique feed rollers 32*b*, that is, when P1≦P2, the driving roller 332*b* of the pair of second oblique feed rollers 32*b* yield to pressure more largely than the driving roller 332*a* of the pair of first oblique feed rollers 32*a*. The conveying speed of the pair of second oblique feed rollers 32*b* is higher than that of the pair of first oblique feed rollers 32*a*. The rotated sheet S can be quickly controlled so as to be in substantially parallel with the reference member 31. Likewise, for the third skew feeding correction roller 332*c*, P2≦P3. The posture of the sheet S is more stable.

The nip pressures P1 to P3 are set so as to be higher toward the downstream in the sheet conveying direction. The conveying force of the pairs of oblique feed rollers 32*a* to 32*c* is increased from the sheet feeding side to the sheet discharge side. The conveying force is set to be larger toward the sheet discharge direction. The posture of the sheet S is quickly along the reference member 31 each time the sheet S is nipped and pressed by the skew feeding correction roller on the downstream. The sheet conveyance can be stabilized.

As described above, in this embodiment, the posture of the sheet S conveyed to the skew feeding correction device 55 is controlled. The collision of the side end of the sheet with the upstream end in the sheet conveying direction of the reference member 31 can be prevented. In other words, the sheet obliquely conveyed by the pairs of oblique feed rollers 32*a* to 32*c* is warped between the pairs of oblique feed rollers 32*a* to 32*c* and the pairs of conveying rollers 34, the pairs of conveying rollers 34 are separated, thereby preventing the collision of the side end of the sheet with the upstream end of the reference member 31. This can stabilize sheet conveyance at the time of sheet alignment, enabling further response to thin sheets and stabilization of the oblique feed elimination performance. In addition, together with the oblique feed roller, the conveying roller device 50 nips the sheet to be conveyed to the skew feeding correction device 55. The nip release timing of the pairs of conveying rollers 34 can be delayed. This can secure a margin in the direction delaying the nip release start timing and can make the registration of the side registration system faster. The conveying force of the pair of oblique feed rollers 32 is larger toward the downstream so that the posture of the rotated sheet S can be quickly along the reference member 31.

In this embodiment, the skew feeding correction device 55 may be arranged in front of the secondary transfer portion. The skew feeding correction device 55 may be arranged in the sheet conveying path after fixing, not in front of the secondary transfer. In addition, the speed Vp of the pairs of conveying rollers 34 may be subjected to a plurality of speed settings in which the speed Vp of the pair of conveying rollers 34 is about 2% to 6% higher than the speed $Vs \cdot \cos \alpha$ in the conveying direction component of the pair of oblique feed rollers 32 according to the type (size, grammage, and fiber orientation) of sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-153215, filed Jun. 29, 2009, which is hereby incorporated by reference herein in its entirety.

What is claimed is:

1. A sheet conveying apparatus which conveys a sheet, comprising:

a pair of first oblique feed rollers which obliquely convey the sheet;

a pair of second oblique feed rollers which are arranged downstream in the sheet conveying direction of the pair of first oblique feed rollers and which obliquely convey the sheet;

a reference surface which is arranged along the sheet conveying direction and onto which the side end of the sheet obliquely conveyed by the pair of first oblique feed rollers and the pair of second oblique feed rollers is abutted, thereby correcting skew feeding of the sheet;

a pair of conveying rollers which convey the sheet to the pair of first oblique feed rollers, a sheet conveying speed of the pair of conveying rollers in the sheet conveying direction being set to be higher than a sheet conveying speed of the pair of first oblique feed rollers in the sheet conveying direction;

a separation mechanism which separates the pair of conveying rollers; and a controlling portion which controls the separation mechanism so that the pair of conveying rollers is separated after a sheet conveyance by the pair of first oblique feed rollers has elapsed a predetermined time before the sheet conveyed by both of the pair of conveying rollers and the pair of first oblique feed rollers reaches the pair of second oblique feed rollers.

2. The sheet conveying apparatus according to claim 1, wherein the controlling portion controls a motor so that the sheet conveying speed of the pair of conveying rollers is higher than that of the pair of first oblique feed rollers in accordance with the type and size of sheet.

3. An image forming apparatus which forms an image on a sheet conveyed by a sheet conveying apparatus by an image forming portion, the sheet conveying apparatus comprising:

a pair of first oblique feed rollers which obliquely convey the sheet;

a pair of second oblique feed rollers which are arranged downstream in a sheet conveying direction of the pair of first oblique feed rollers and which obliquely convey the sheet;

a reference surface which is arranged along the sheet conveying direction and onto which the side end of the sheet obliquely conveyed by the pair of first oblique feed rollers and the pair of second oblique feed rollers is abutted, thereby correcting skew feeding of the sheet;

a pair of conveying rollers which convey the sheet to the pair of first oblique feed rollers, a sheet conveying speed of the pair of conveying rollers in the sheet conveying direction being set to be higher than a sheet conveying speed of the pair of first oblique feed rollers in the sheet conveying direction;

a separation mechanism which separates the pair of conveying rollers; and a controlling portion which controls the separation mechanism so that the pair of conveying rollers is separated after a sheet conveyance by the pair of first oblique feed rollers has elapsed a predetermined time before the sheet conveyed by both of the pair of conveying rollers and the pair of first oblique feed rollers reaches the pair of second oblique feed rollers.

4. The image forming apparatus according to claim 3, wherein the controlling portion controls a motor so that the sheet conveying speed of the pair of conveying rollers is higher than that of the pair of first oblique feed rollers in accordance with the type and size of sheet.

* * * * *